United States Patent [19]

Connell et al.

[11] 4,010,705

[45] Mar. 8, 1977

[54] ROTATIONAL ENERGY ABSORBER APPARATUS FOR HYDROFOIL CRAFT STRUT

[76] Inventors: John Bradford Connell, 641 - 212th Ave. SE., Redmond, Wash. 98052; John Weaver Williams, 16721 SE. 12th, Bellevue, Wash. 98008

[22] Filed: Oct. 6, 1975

[21] Appl. No.: 620,076

[52] U.S. Cl. ..... 114/279

[51] Int. Cl.² ..... B63B 1/28

[58] Field of Search ..... 114/66.5 H, 162; 64/28 R; 188/1 C

[56] References Cited

UNITED STATES PATENTS

| | | | |
|---|---|---|---|
| 2,566,690 | 9/1951 | Wright | 64/28 R |
| 2,845,144 | 7/1958 | Bohn | 188/1 C |
| 3,185,120 | 5/1965 | Bader | 114/66.5 H |
| 3,342,155 | 9/1967 | Hook | 114/66.5 H |
| 3,910,215 | 10/1975 | Soderman | 114/66.5 H |

*Primary Examiner*—George E. A. Halvosa
*Assistant Examiner*—Gregory W. O'Connor

[57] ABSTRACT

A set of plates, one rigidly mounted to the strut and the others to the craft structure. The plates are held together and are interconnected to one another by several sets of dowel pins which are sequenced to shear when an impact load at the foil rotates the strut. Thereafter, a pair of additional energy absorber devices, positioned to the left and right of the strut mounted plate, will likewise absorb energy until a rigid stop is obtained. Finally, a tang portion on the strut mounted plate will be sheared by the rigid stop at a load below which the strut will obtain damage.

11 Claims, 13 Drawing Figures

Fig. 1
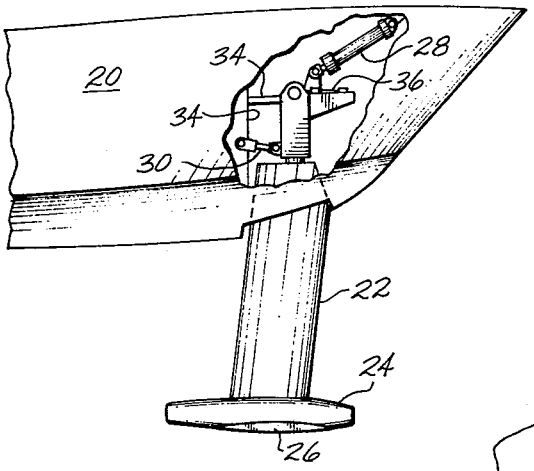
Fig. 2
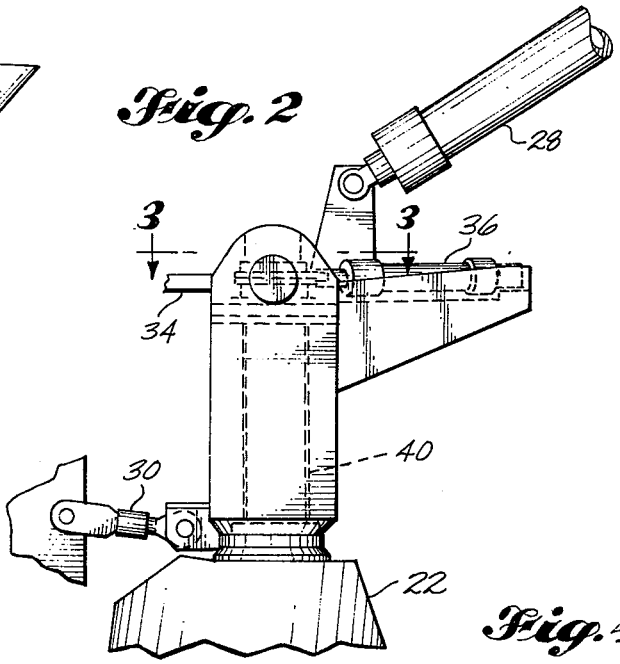
Fig. 3
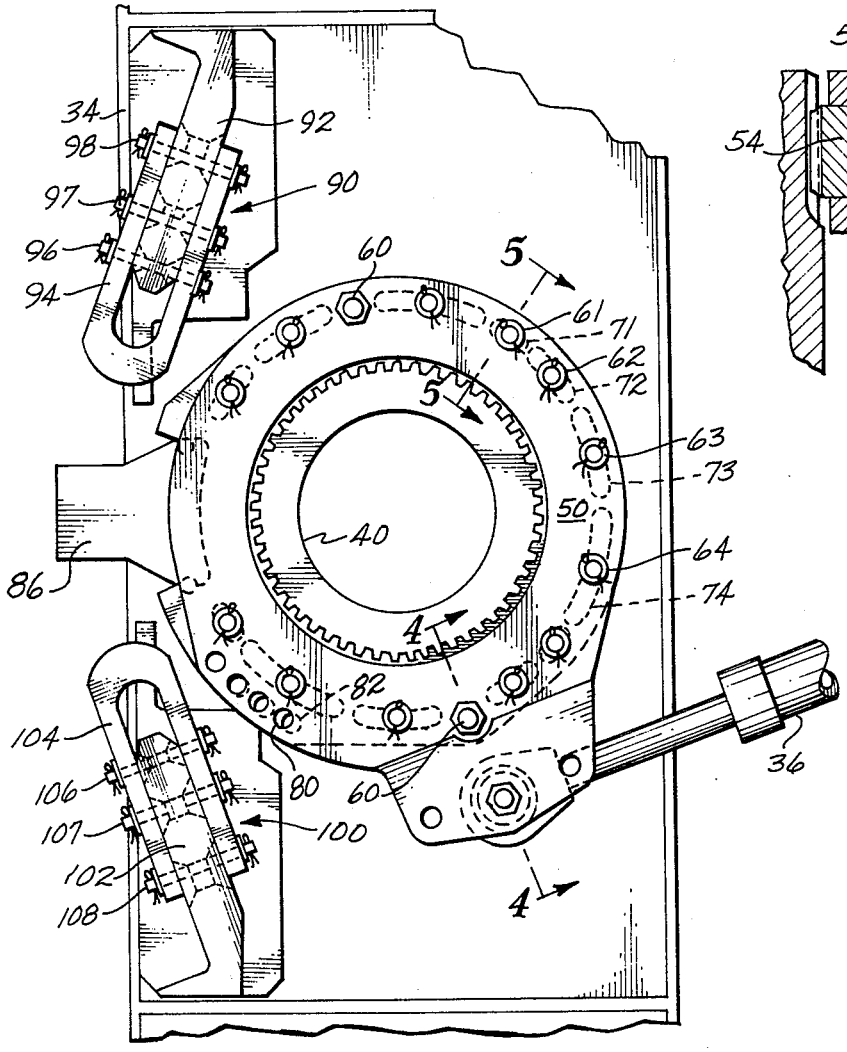
Fig. 4
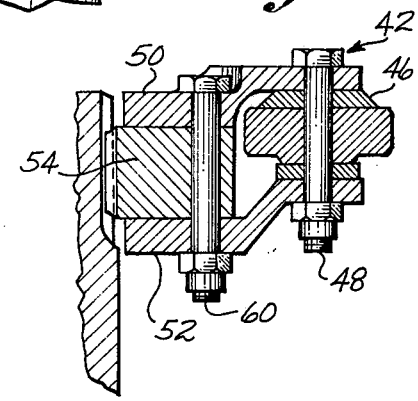
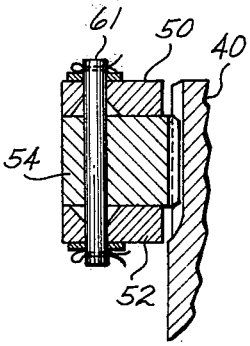
Fig. 5

ROTATIONAL ENERGY ABSORBER APPARATUS FOR HYDROFOIL CRAFT STRUT

STATEMENT OF GOVERNMENT INTEREST

The invention described herein may be manufactured by or for the Government of the United States of America for governmental purposes without the payment of any royalties thereon or therefor.

BACKGROUND OF THE INVENTION

The present invention relates to hydrofoil craft, and more particularly to a safety support system for the foil-carrying struts.

Hydrofoil craft have foils which move through the water during flight, that is, during foil-borne operation of the craft, and develop lift in much the same manner as an airplane wing. The foils are carried on struts which are attached to the hull of the craft and hold the hull clear of the water during flight. The struts are usually mounted on the hull in a manner which permits the struts to be retracted so that the hull can float on the water and the craft can be operated in a hull-borne mode as a conventional ship.

When foil-borne operation is desired, the struts are moved to their extended position and locked in place. In this mode of operation, very high speeds can be attained as compared with conventional ship speeds. These high speeds, however, involve a safety problem resulting from the possible presence of floating or submerged objects in the water in unexpected or unpredictable places. If one of the struts or foils strikes a sizable object of this kind, such as a floating log, for example, while traveling at high speed, the resulting impact force can cause an extremely rapid deceleration of the craft, with possible damage to the foil-support system and to the hull structure itself. This abrupt deceleration between the time of impact and the time of becoming hull-borne as the craft settles on the water can be quite dangerous to passengers or crew members on board the craft.

For this reason, most of the conventional hydrofoil craft employ a safety device or mechanical fuse which absorbs impact energy and permits the strut to fold up. However, those safety devices are only effective when the impact is at the strut or at the foil close to the strut-foil junction. Impact which would occur at the foil and, in particular, at the foil tip will not directly result in a load that tends to fold the strut; on the contrary, such impacts will cause a rotational force to the strut. Thus far the prior art does not disclose any solutions towards solving such a problem in a sophisticated controlled manner.

Accordingly, the apparatus of the present invention is designed to control a forced rotational rate and degree of rotation of a single strut in the event of an impact from logs or debris on the outboard portions of the foil.

Uncontrolled rotation of the strut from such an impact can cause hull structural damage, strut support damage and, in severe cases, failure of the strut.

Previous devices consist of mounting several shear pins at the strut and craft junction, or in the event where the strut acts as a rudder and thus is adapted to rotate along its longitudinal axis, the shear pin solution exist between the actuator means and the strut steering arm. Such a conventional shear-pin solution may prevent damage to the steering mechanism; however, a sudden rotation of the strut at a high speed could cause very high hydrodynamic loads on the strut which could cause catastrophic failure of the strut. Also, the sudden change from foil-borne to hull-borne will be dangerous to people aboard the craft.

Accordingly, the present invention is designed to absorb the impact energy and allow strut rotation in a controlled mode. The impact energy will be absorbed in various small steps and appear as a smooth changeover instead of the sudden shear-pin break change. The severity of the shock is thus lessened by stretching the time element of energy absorption, even though the time frame is still extremely short.

It is another objective to provide an apparatus which will prevent severe structural damage to the strut/foil and hull portions of the craft.

It is a further object of the present invention to provide for a strut energy impact absorption apparatus which after an impact occurrence has the means for immediate emergency repair, to connect the realignment of the strut for retraction and continuance of the voyage.

SUMMARY OF THE INVENTION

In accordance with the present invention, a safety mounting support system is provided for the struts of a hydrofoil craft which limits or reduces the rate of deceleration resulting from impact forces caused by one of the foils striking a floating or submerged object, and which limits or minimizes the possible structural damage by providing a predetermined failure path.

For these purposes, the struts are supported on the hull in a manner to permit rotational movement toward port or starboard, but are normally held against such movement by substantially rigid restraining means. Because a strut is either fixedly positioned or can be retracted and in its most sophisticated fashion may also be steerable, as for example the single forward steering strut in the "Canard" configuration or the single aft steerable strut in the "Aeroplane" configuration, the present invention is described hereinafter for the steerable strut concept. The steerable strut is generally connected to a steering actuator which also has to be protected from damage.

The novel features which are believed to be characteristic of the invention, both as to its organization and method of operation, together with further objects and advantages thereof, will be better understood from the following description considered in connection with the accompanying drawings in which an embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a side view of the bow of a hydrofoil craft employing a single steerable forward strut. A portion of the hull skin has been deleted in order to show the arrangement of the major components and their connections to the strut and craft.

FIG. 2 is an enlarged view of the upper strut assembled arrangement.

FIG. 3 is a plan view of the rotation energy absorber apparatus and is taken on line 3—3 of FIG. 2.

FIG. 4 is a view taken on the line 4—4 of FIG. 3.

FIG. 5 is a view taken on the line 5—5 of FIG. 3.

DESCRIPTION AND OPERATION OF THE PREFERRED EMBODIMENT

Figure 6:
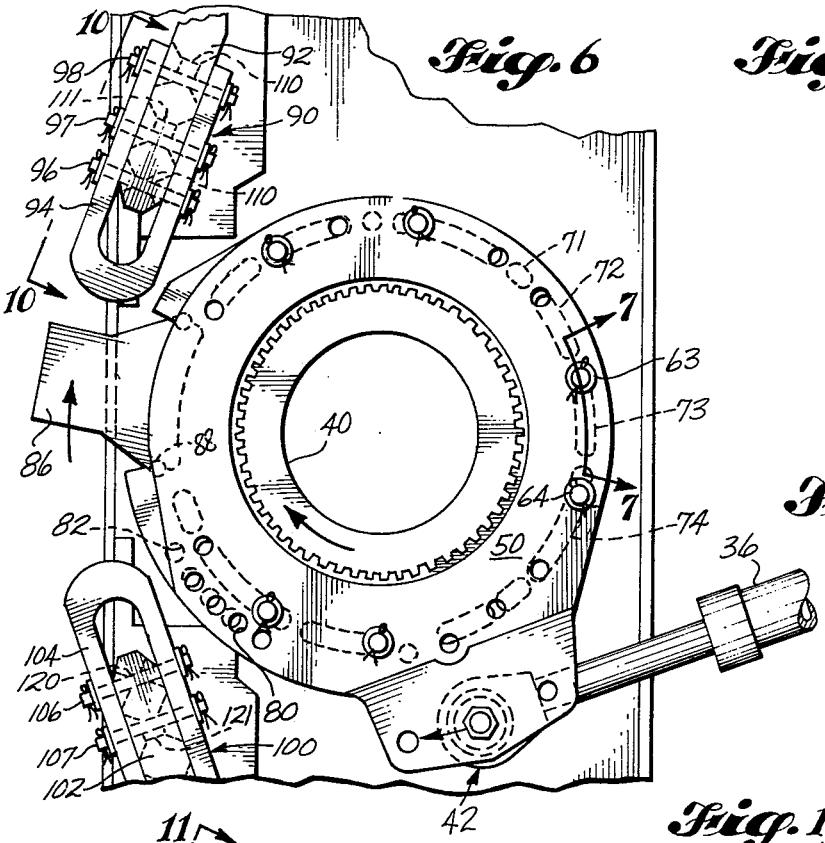
FIGS. 6, 9, 12 and 13 are similar to the plan view shown in FIG. 3; however, the strut has been forcefully rotated due to a foil impact, and each view shows respectively a larger rotation.

The invention is shown in a hydrofoil craft 20 which has a forward strut 22 with a strut pod 24 carrying the foil 26.

The strut 22 can be retracted in a forward raised position when the craft is hullborne by the retraction actuator 28.

A mechanical fuse or shearing means 30 is employed between the strut and the craft structure 34 for absorbing impact energy which is directly experienced on the strut 22, the pod 24 or close to the foil pod undersection.

In the more detailed picture, FIG. 2, it will be observed that the strut 22 is rotationally mounted and can serve as a rudder by being steered through the steering actuator 36.

The steering actuator 36 will rotate the strut upon activation and, as shown in FIG. 3, is adapted to move the king post or strut axle 40 clockwise or counterclockwise within limited degrees by way of the pivot point connection 42. For simplicity, th pivot point connection 42 is shown utilizing washers 46 and pivot pin 48.

Between the pivot point connection 42 and the axle 40 there are a pair of substantially round-shaped plates or outer plate means 50 and 52 which are mounted to a strut plate 54 which is securely mounted or splined to the axle 40 as illustrated in FIGS. 3–6, 9, 12 and 13.

The mounting of the outer plates 50 and 52 to the inner or strut plate 54 is accomplished by a pair of bolts 60 and further to some extent by four sets of three dowel shearing pins 61, 62, 63, and 64. The arrangement of each set of dowel shearing pins is substantially in an even-spaced relationship around the axle 40 in the plates 50, 52 and 54. Accordingly, upon initial impact, first the two bolts 60 will snap off and then consecutively each set of shearing pins 61, 62 and 63.

The strut plate 54 is further provided with four sets of sequentially larger slotted holes 71, 72, 73 and 74 which are also chamferred at each side of the plate 54 so that the dowel pins are not directly sheared but bend before shearing which will absorb a lot more energy than a direct shear. A plurality of holes 80 are provided in the plate 54 which have relationship with similar holes 82 which are provided in the plates 50 and 52. The purpose of these holes 80 and 82 is to present the possibility to realign the strut 22 with the steering actuator 36 in the event that the rotational energy absorber has been used, so that the craft may continue its voyage towards a repair base.

The strut plate 54 is further provided with a lug or tang portion 86 that is splined to the plate 54 by spline pins 88.

A pair of right- and left-hand stop means 90 and 100 are positioned at a spaced location in line of travel with the range portion 86 in such a manner that upon rotation of the plate 54 the lug will eventually contact the right- or the left-hand stop means 90 and 100.

Each stop means 90 and 100 is made of two parts, a first portion 92 or 102 rigidly attached to the craft's structure 34, and a thereabout telescoping second portion 94 or 104 which are connected by three sets of shearing bolts or yieldable restraining means 96, 97, 98 or 106, 107, 108, respectively, located in sequentially larger slotted holes 110, 111, 112 and 120, 121, 122, respectively. These holes are chamferred so that a large amount of energy will be absorbed by the same bending/shearing principle as discussed before. FIGS. 7, 8, 10 and 11 illustrate the effect caused to the shear pins when the strut plate has rotated.

Figure 7:
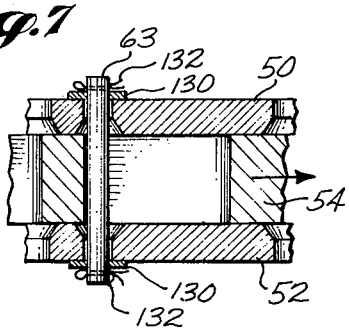
FIG. 7 is a view taken on the line 7—7 of FIG. 6.
Figure 8:
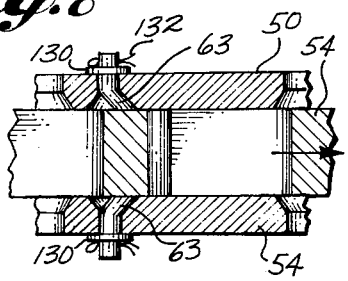
FIG. 8 is similar to FIG. 7; however, the rotation of the strut continued and the shearing of the shearing dowel pin is in process.
Figure 9:
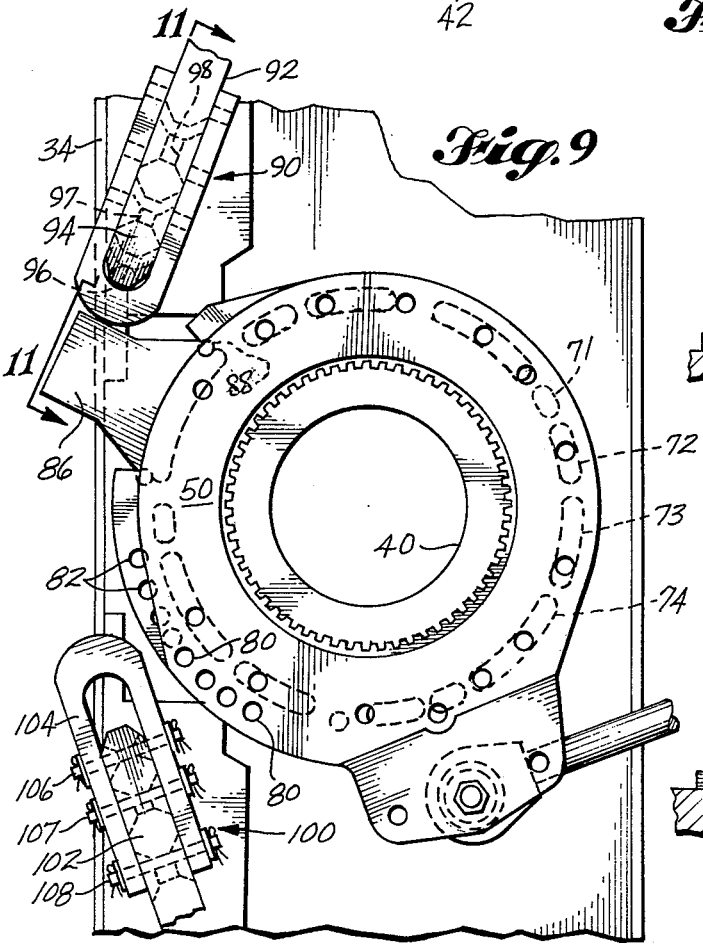

In FIG. 7 it is shown that the dowel pin is kept by a washer and cotter pin 130 and 132 into position and in FIG. 8 the bending-shearing force has first bent and then sheared the dowel at each end.

Figure 10:
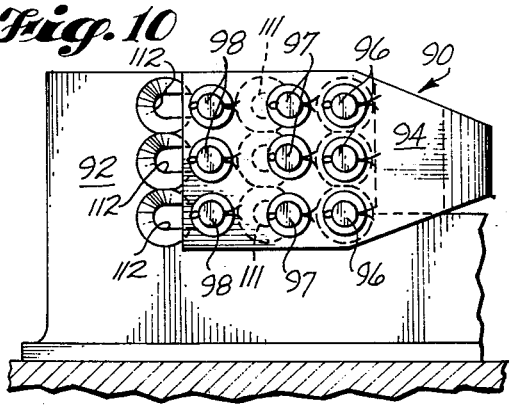
FIG. 10 is a view taken on line 10—10 of FIG. 6.
Figure 11:
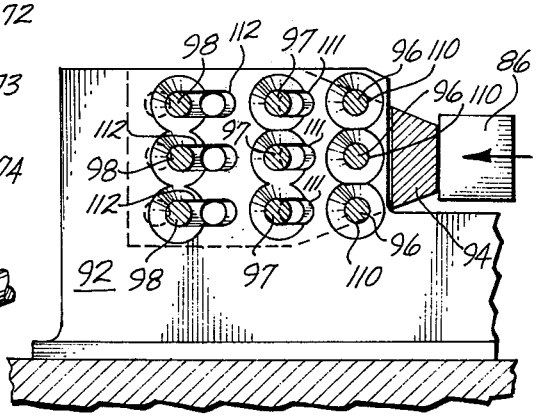
FIG. 11 is a view taken on line 11—11 of FIG. 9.
Figure 12:
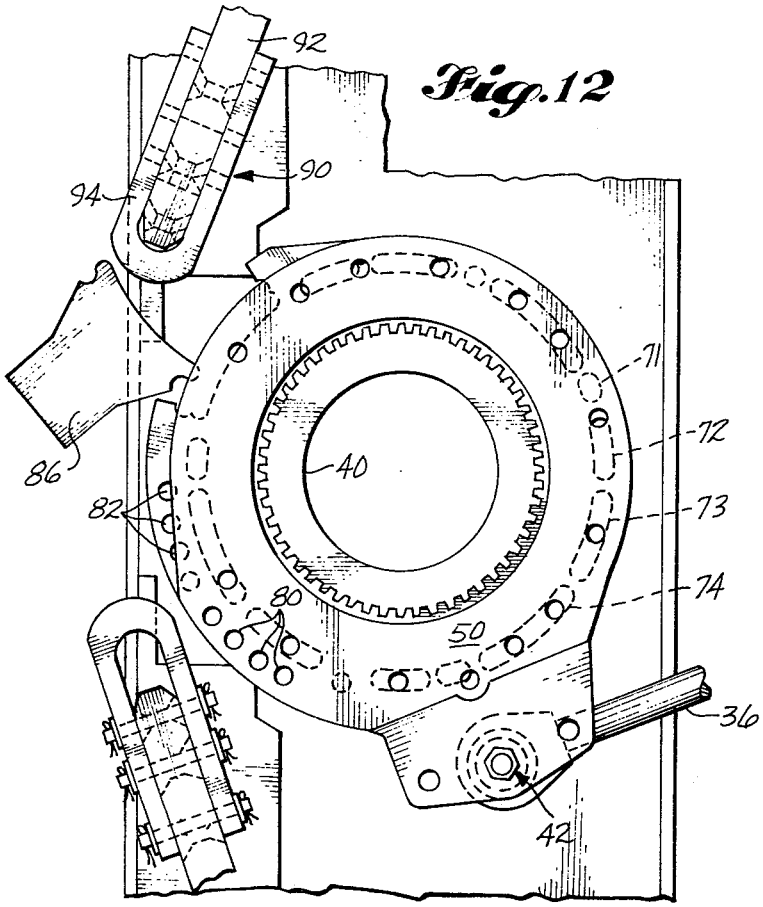
Figure 13:
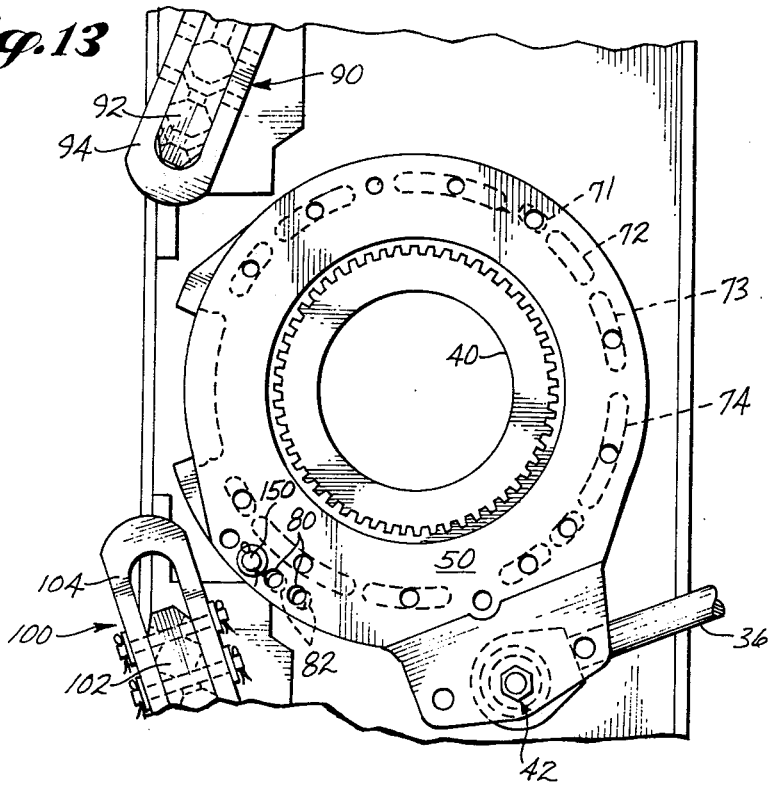

A similar experience occurs to the yieldable restraining means at the stop means 90, as illustrated in FIGS. 10 and 11 successively.

As illustrated in FIG. 11, the first function of the stop means 90 is completely utilized. The three sets of yieldable restraining means are sheared off and the second portion 94 is telescoped or retracted onto the first rigidly mounted portion 92. The second function of the stop means 90 becomes evident when studying the FIG. 12, wherein the tang 86 which was splined to the strut plate, sheared off upon continued rotation of the strut plate 54.

Thus it will be obvious that upon an impact which causes a strut rotation about the strut longitudinal axis, the strut and foils are protected from damage by the absorption of the energy in the step-by-step energy absorbing shearing action of the fasteners, dowel pin, yieldable restraining means and the tang portion, After the tang portion is sheared, the strut plate will be free from the center plate means and thus the strut is completely free to rotate and disable the craft for continued voyage. In order to continued in the hullborne mode it would be preferred that the strut is retracted for the elimination of its inherent drag. To accomplish retraction of the strut by the retraction actuator 28 the strut plate and the outer plate means are provided with a series of spaced holes 80 and 82. By approximate positioning, one will be able to line up at least two holes so that a pin or interconnecting means 150 can be inserted and fastened.

Having thus described the many useful and novel features of the present invention in connection with the accompanying drawings, it will be seen that the several useful objects for which it was designed have been achieved. Although but a single specific form of the invention has been illustrated and described herein, it is realized that certain changes and modifications therein may occur to those skilled in the art within the broad teaching hereof; hence, it is the intention that the scope of protection afforded hereby shall be limited only insofar as said limitations are expressly set forth in the appended claims.

Now, therefor, we claim:

1. Rotational energy absorbing apparatus for the protection of a hydrofoil craft strut/foil means against impact energy damage causing strut axis rotation, comprising in combination:

a. a strut plate means rigidly mounted to said strut;

b. an outer plate disposed on said strut plate and rigidly mounted to said craft structure;

c. a plurality of yieldable means connected to said strut plate and to said outer plate and adapted for sequential shearing when said strut plate rotates about a substantially common perpendicular axis between said strut and said outer plate which axis is substantially parallel with said strut rotation axis and whereby each shearing action of each said plurality of yieldable means is adapted to take a part of said associated impact energy;

d. stop means mounted adjacent said strut plate;

e. said stop means including a rigidly mounted first portion and a second portion yieldably mounted by at least one yieldable restraining means to said first portion, and f. a strut plate portion adapted to contact said second portion when said strut plate rotates and has sheared off said yieldable means and whereby said strut plate portion is adapted to dislocate said second portion in respect to said first portion, thereby shearing said yieldable restraining means.

2. A rotational energy absorbing apparatus as claimed in claim 1 wherein said strut plate portion is yieldably attached to said strut plate so that after said second portion has been dislocated said strut plate will be sheared off by continuous rotation against said stop means.

3. A rotational energy absorbing apparatus as claimed in claim 2 wherein said outer plate rigid to craft structure mounting comprises a strut steering actuator assembly connected to said outer plate and wherein said steering actuator has a bursting pressure which is above a shearing pressure force resulting from said associated impact energy adequate to shear said yieldable means, said yieldable restraining means and said strut plate portion attached to said strut, respectively.

4. Rotational energy absorbing apparatus for the protection of a hydrofoil craft strut/foil means against impact damage causing strut axis rotation comprising in combination:

a. a strut plate means rigidly mounted to said strut and having a yieldable tang portion yieldably connected onto said strut plate means;

b. an outer plate means disposed in surface contact with said strut plate means and connected therewith by a number of yieldable means which are adapted for sequentially shearing from said strut plate means, said outer plate means rigidly mounted to said hydrofoil craft structure so that said yieldable means shears off at a load below said strut plate means to strut rigid mounting and said outer plate means to hydrofoil craft structure rigid mounting, when said associated impact damage occurs;

c. stop means positioned at predetermined opposite locations next to said strut plate and in alignment with said tang portion so that upon shearing of said yieldable means said strut plate dislocates and said tang portion contacts said stop means;

d. said stop means comprising a first portion rigidly attached to said hydrofoil craft structure and a second portion yieldably mounted by yieldable restraining means onto said first portion and adapted to be sheared and dislocated from said first portion by said tang portion;

e. said tang portion yieldable connection adapted to shear from said strut plate means, after said second portion has been sheared and dislocated from said first portion, by having a lower shearing load than said rigid attachment of said first portion onto said hydrofoil craft structure so that said tang portion yieldable connection shears from said strut plate means after said second portion of said stop means has been sheared and dislocated from said first portion of said stop means.

5. A rotational energy absorbing apparatus as claimed in claim 4 wherein said number of yieldable means for sequential shearing comprises a series of sets of dowel pins, each set having a plurality of pins located at spaced locations and wherein the first set is held in holes which are chamferred in said outer plate means and said second and following sets are held in chamferred and sequentially larger slotted holes in said outer plate and said strut plate so that energy absorption is created in sequential order by each said sets.

6. A rotational energy absorbing apparatus as claimed in claim 5 wherein said stop means yieldable restraining means comprises a number of dowel pin means located at spaced intervals from one another and adapted to shear at sequential order whereby the first dowel pin means is located in chamferred hole means and each said following dowel pin means in sequentially larger slotted chamferred holes provided in one of said portions of said stop means for providing sequential energy absorption.

7. A rotational energy absorption apparatus as claimed in claim 6 wherein said stop means comprises said second portion being shaped as to telescope about said first portion and adapted to bottom out thereon when said yieldable restraining means are sheared.

8. A rotational energy absorption apparatus as claimed in claim 7 wherein said outer plate means comprises a set of plates enveloping said strut plate means on each side thereof.

9. A rotational energy absorption apparatus as claimed in claim 8 wherein said outer plate means rigid mounting to said hydrofoil craft structure comprises a rigid pivotal mounting onto an associated strut steering actuator means and wherein said shearing of said yieldable means at a load below said rigid pivotal mounting relates to a load less than said actuator bursting pressure load.

10. A rotational energy absorption apparatus as claimed in claim 9 wherein said strut plate means and said outer plate means have a substantial circular shape and wherein said strut plate is adapted to rotate about said strut longitudinal axis during and upon shearing off of said yieldable means, said yieldable restraining means and said tang portion.

11. A rotational energy absorbing apparatus as claimed in claim 10 wherein said strut plate and said outer plate means are provided with means to temporarily connect said strut plate with said outer plate means in approximately prior impact position.

* * * * *